US010625102B1

(12) United States Patent
Chen

(10) Patent No.: US 10,625,102 B1
(45) Date of Patent: Apr. 21, 2020

(54) GAUZE MASK STRUCTURE CAPABLE OF SEPARATING INHALATION AND EXHALATION

(71) Applicant: Chung-Yung Chen, Taichung (TW)

(72) Inventor: Chung-Yung Chen, Taichung (TW)

(73) Assignee: Chung-Yung Chen, Taichung (TW)

( * ) Notice: Subject to any disclaimer, the term of this patent is extended or adjusted under 35 U.S.C. 154(b) by 0 days.

(21) Appl. No.: 16/411,274

(22) Filed: May 14, 2019

(51) Int. Cl.

| | |
|---|---|
| ***A62B 7/10*** | (2006.01) |
| ***A41D 13/11*** | (2006.01) |
| ***A62B 18/10*** | (2006.01) |
| ***A62B 9/02*** | (2006.01) |
| ***A62B 9/06*** | (2006.01) |
| ***A62B 18/02*** | (2006.01) |

(52) U.S. Cl.
CPC ..... *A62B 7/10* (2013.01); *A41D 13/1161* (2013.01); *A62B 9/02* (2013.01); *A62B 9/06* (2013.01); *A62B 18/025* (2013.01); *A62B 18/10* (2013.01)

(58) Field of Classification Search
CPC ..... A62B 7/10; A62B 9/02; A62B 18/025; A62B 18/10
USPC ..... 128/207.12, 205.24, 206.21, 206.28
See application file for complete search history.

(56) References Cited

U.S. PATENT DOCUMENTS

| | | | | |
|---|---|---|---|---|
| 5,331,957 | A * | 7/1994 | Liu | A41D 13/1146 128/206.15 |
| 6,338,340 | B1 * | 1/2002 | Finch | A62B 18/084 128/205.27 |
| 10,322,312 | B1 * | 6/2019 | Danford | A63B 23/18 |
| 2012/0247474 | A1 * | 10/2012 | Torbenson | A62B 18/02 128/206.15 |
| 2017/0172137 | A1 * | 6/2017 | Wynalda, Jr. | A01M 31/004 |
| 2019/0166929 | A1 * | 6/2019 | Bergman | A41D 13/1138 |

* cited by examiner

*Primary Examiner* — Kristen Matter

(57) ABSTRACT

An improved gauze structure capable of separating inhalation and exhalation includes: an outer layer member, a top and a bottom portions thereof are formed with at least one first through hole, a center at the bottom portion is formed with a first front hole; an inner layer member, a top and a bottom portions thereof are formed with at least one second through hole, a center at the bottom portion is formed with a second front hole, at least one fastening unit is disposed at two sides; an inner mask member, used for covering a mouth, and formed with at least one third through hole and a connection part; and at least two air valves, disposed corresponding to the first and the second through holes at the top and bottom portions of the outer and the inner layer members and the third through hole of the inner mask member.

6 Claims, 6 Drawing Sheets

GAUZE MASK STRUCTURE CAPABLE OF SEPARATING INHALATION AND EXHALATION

BACKGROUND OF THE INVENTION

1. Field of the Invention

The present invention relates to an improved gauze mask structure, especially to an improved gauze mask structure capable of separating inhalation and exhalation which can be applied to a nose and a mouth of a human face.

2. Description of Related Art

The structure of a conventional gauze mask is to cover a nose and a mouth of a human face at the same time; when in use, the air exhaled from the human contains a great amount of carbon dioxide, due to the nose and the mouth being covered by the gauze mask and an affection caused by the filtering material of the gauze mask, the air containing a great amount of carbon dioxide could not be easily and completely discharged via the gauze mask, so that an internal space of the gauze mask still has a lot of exhaled air, when fresh air is inhaled by the human, the air containing oxygen is sucked in from the outer side of the gauze mask and passes through the filtering material to enter the inner side of the gauze mask, but the exhaled air remained inside the gauze mask and containing a great amount of carbon dioxide may be mixed with the fresh air containing oxygen and inhaled by the human, thus the gauze mask, which is used for preventing the human from inhaling polluted objects, may not be able to supply sufficient oxygen to the human, and the health of the human may be affected; moreover, the conventional gauze mask cannot be connected to an external equipment, for example an oxygen container, and cannot be applied to various fields, thus the practicability thereof is very much limited; accordingly, the above-mentioned disadvantages shall be improved by the skilled people in the air for providing a better product to the consumers.

SUMMARY OF THE INVENTION

For solving the disadvantages existed in the prior art, one primary objective of the present invention is to provide an improved gauze structure capable of separating inhalation and exhalation, with an air valve disposed at top portion of an outer layer member and an inner layer member and an inner mask member and an air valve disposed at bottom portions thereof or a cover member or a connection head disposed in a connection portion of the inner mask member, the disadvantages existed in the prior art can be overcome.

Another objective of the present invention is to provide an improved gauze structure capable of separating inhalation and exhalation, in which an outer layer member and an inner layer member are served to cover a nose and a mouth of a human face, air inhaled from the nose can be separated from air exhaled from the mouth via an inner mask member and discharged the air exhaled from the nose and the mouth of the human face via an air valve, or air inhaled from the mouth of the human face via a connection part connected to an external equipment and discharged from the nose and the mouth of the human face via the air valve.

One another objective of the present invention is to provide an improved gauze structure capable of separating inhalation and exhalation, which has advantages of effectively increasing the oxygen contained in the inhaled air, preventing the fresh air mixed with the exhaled air containing carbon dioxide from being inhaled and capable of being applied in various fields.

The problems to be solved by the present inventions are: in a conventional gauze mask, due to the nose and the mouth being covered by the gauze mask and an affection caused by the filtering material of the gauze mask, the air containing a great amount of carbon dioxide could not be easily and completely discharged via the gauze mask, so that an internal space of the gauze mask still has a lot of exhaled air, when fresh air is inhaled by the human, the exhaled air remained inside the gauze mask may be mixed with the fresh air, thus the gauze mask may not be able to supply sufficient oxygen to the human, and the health of the human may be affected;

moreover, the conventional gauze mask cannot be connected to an external equipment, for example an oxygen container, and cannot be applied to various fields, thus the practicability thereof is very much limited.

For achieving said objective, one technical solution provided by the present invention is to provide an improved gauze structure capable of separating inhalation and exhalation, which is applied to a human face and a nose and a mouth thereof, and characterized in that: the gauze mask includes:

an outer layer member, provided for covering the nose and the mouth of the human face, a top portion and a bottom portion of the outer layer member are respectively formed with at least one first through hole, a center defined at the bottom portion of the outer layer member is formed with a first front hole arranged adjacent to the first through hole at the bottom portion of the outer layer member, and two sides of the outer layer member are disposed with at least one fastening unit for being fastened on a rear head portion of the human face;

an inner layer member, combined at an inner side of the outer layer member, a top portion and a bottom portion of the inner layer member are respectively formed with at least one second through hole, a center defined at the bottom portion of the inner layer member is formed with a second front hole arranged adjacent to the second through hole at the bottom portion of the inner layer member, the second through hole and the second front hole at the top portion and the bottom portion of the inner layer member are respectively corresponding to the first through hole at the top portion and the bottom portion of the outer layer member and the first front hole at the center defined at the bottom portion thereof;

an inner mask member, disposed at an inner side of the inner layer member, the inner mask member is provided for covering the mouth of the human face, the inner mask member is formed with at least one third through hole and disposed with a connection part in a protruding status, the third through hole is corresponding to the first through hole at the bottom portion of the outer layer member and the second through hole at the bottom portion of the inner layer member, the connection part is respectively corresponding to the first front hole of the outer layer member and the second front hole of the inner layer member and protruded out from the outer layer member;

and at least two air valves, disposed corresponding to the first through hole at the top portion of the outer layer member and the second through hole at the top portion of the inner layer member, and disposed corresponding to the first through hole at the bottom portion of the outer layer member, the second through hole at the bottom portion of the inner layer member and the third through hole of the inner mask member.

Accordingly, with the outer layer member and the inner layer member and the inner mask member being disposed with the at least two air valves, air inhaled from the nose of the human face and air exhaled from the nose and the mouth is able to be separated.

Wherein, according to the present invention, the fastening unit is disposed at the two sides, formed in an elongated status, of the outer layer member.

Wherein, according to the present invention, each of the air valves includes a top cover and a bottom base capable of being mutually engaged, and a valve piece is disposed between the top cover and the bottom base.

Wherein, according to the present invention, the connection part, protruded out from the outer layer member, of the inner mask member is provided with a cover member.

Wherein, according to the present invention, the connection part, protruded out from the outer layer member, of the inner mask member is provided with a connection head served to be connected to an external equipment enabling the mouth of the human face to inhale air.

Wherein, according to the present invention, the connection head is provided with at least one filter layer.

Comparing to the prior art, advantages achieved by the present invention are as follows: with the air valve disposed at the top portions of the outer layer member and the inner layer member and the inner mask member and the air valve disposed at the bottom portions thereof or the cover member or the connection head disposed in the connection portion of the inner mask member, the air inhaled from the nose via the outer layer member and the inner layer member covering the nose and the mouth of the human face can be separated from the air exhaled from the mouth via the inner mask member and the air exhaled from the nose and the mouth of the human face and discharged via the air valve, or the air inhaled from the mouth of the human face via the connection part connected to the external equipment and the air exhaled from the nose and the mouth of the human face and discharged via the air valve, so that the oxygen contained in the air can be effectively increased, the fresh air mixed with the exhaled air containing carbon dioxide can be prevented from being inhaled; accordingly, the present invention can be applied in various fields, and is novel and more practical in use comparing to the prior art.

DESCRIPTION OF THE CODES

Figure 1:
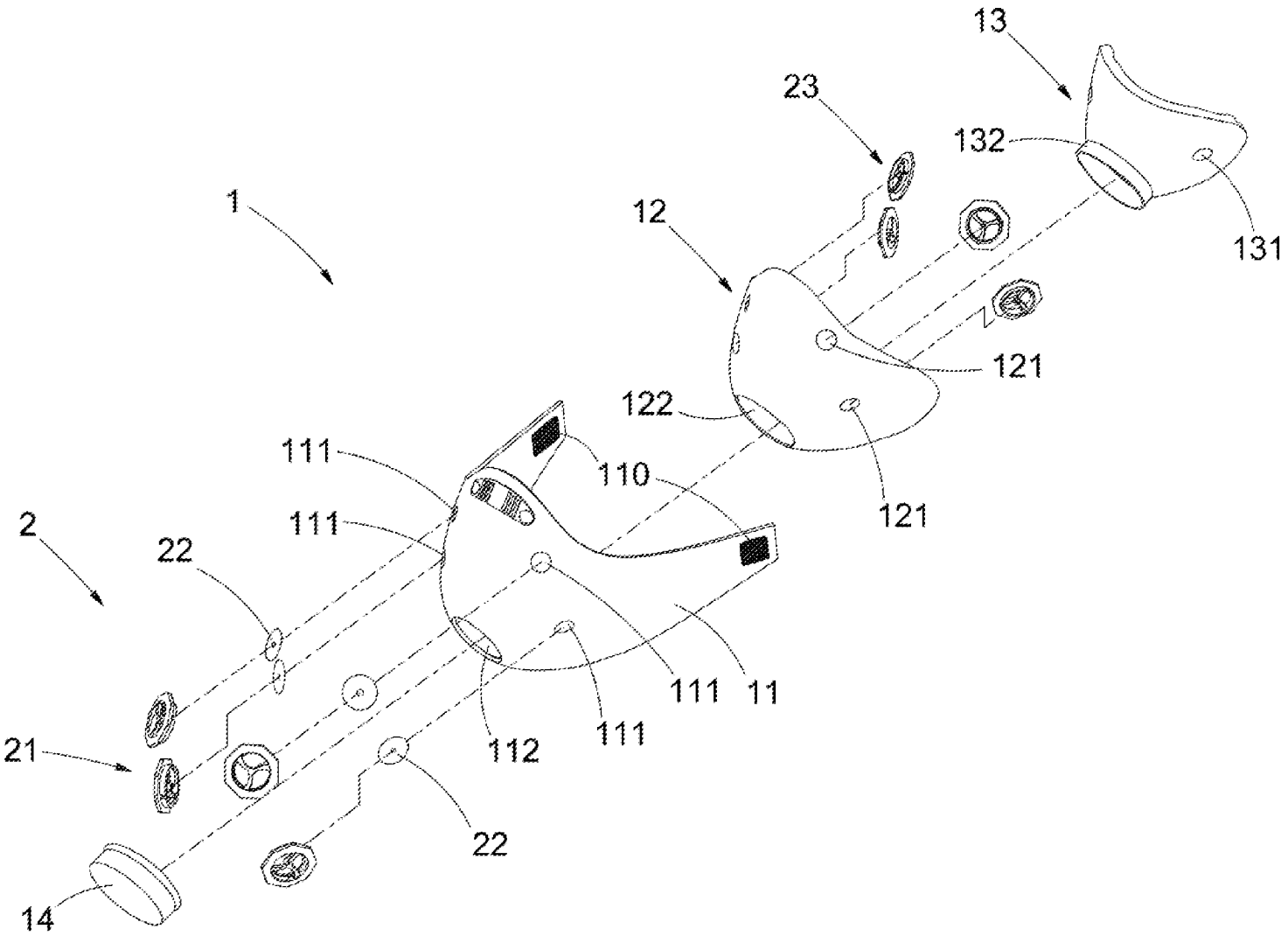
FIG. 1 is a perspective exploded view according to the present invention.

1: Gauze mask
11: Outer layer member
110: Fastening unit
111: First through hole
112: First front hole
12: Inner layer member
121: Second through hole
122: Second front hole
13: Inner mask member
131: Third through hole
132: Connection part
14: Cover member
15: Connection head
151: Filter layer
2: Air valve
21: Top cover
22: Valve piece
23: Bottom base
3: Human face
31: Nose
32: Mouth
4: External equipment

DETAILED DESCRIPTION OF THE PREFERRED EMBODIMENT

One preferred embodiment of the present invention will be described with reference to the drawings for illustrating the structural assembly, the technical means and the functions to be achieved by the present invention; and the actual ratios and the arrangement of components shall not be limited by the ratios and the arrangement of components in the provided figures.

Figure 2:
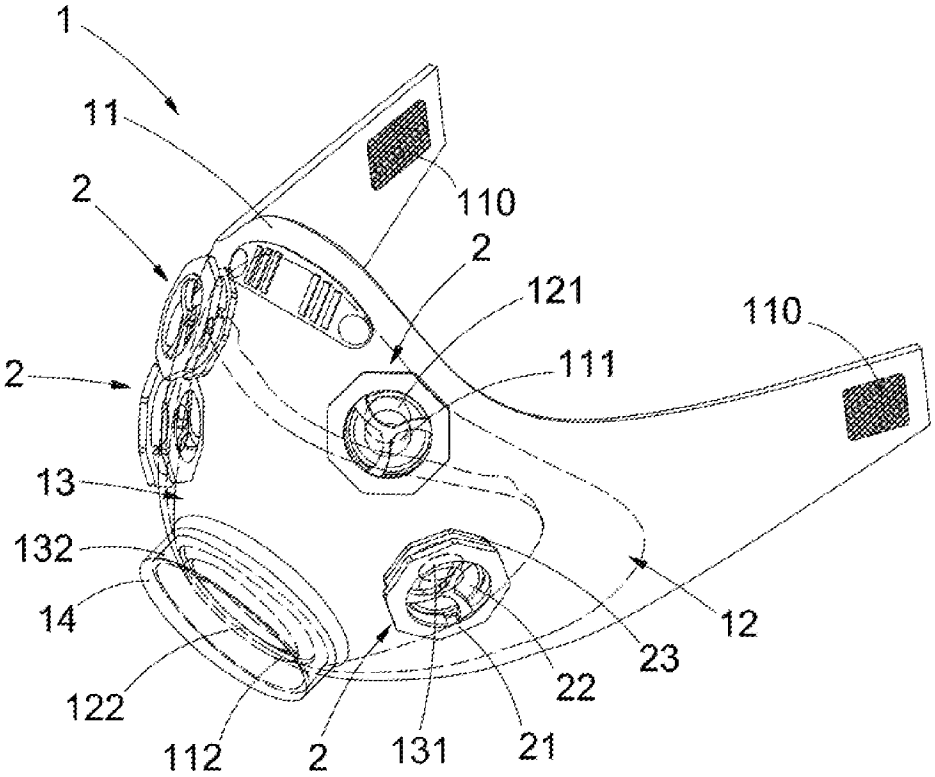
FIG. 2 is a perspective view showing the assembly according to the present invention.
Figure 3:
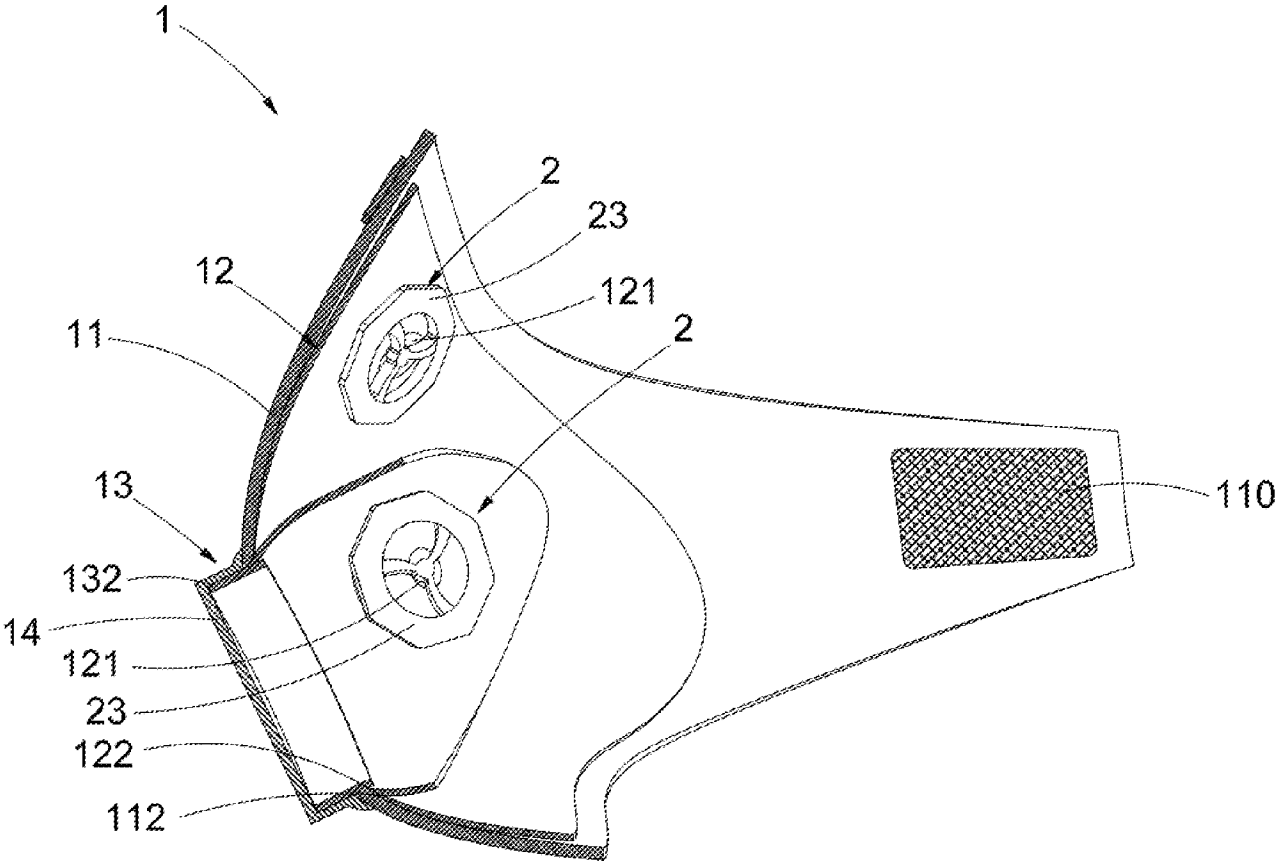
FIG. 3 is a cross sectional view showing the assembly according to the present invention.
Figure 4:
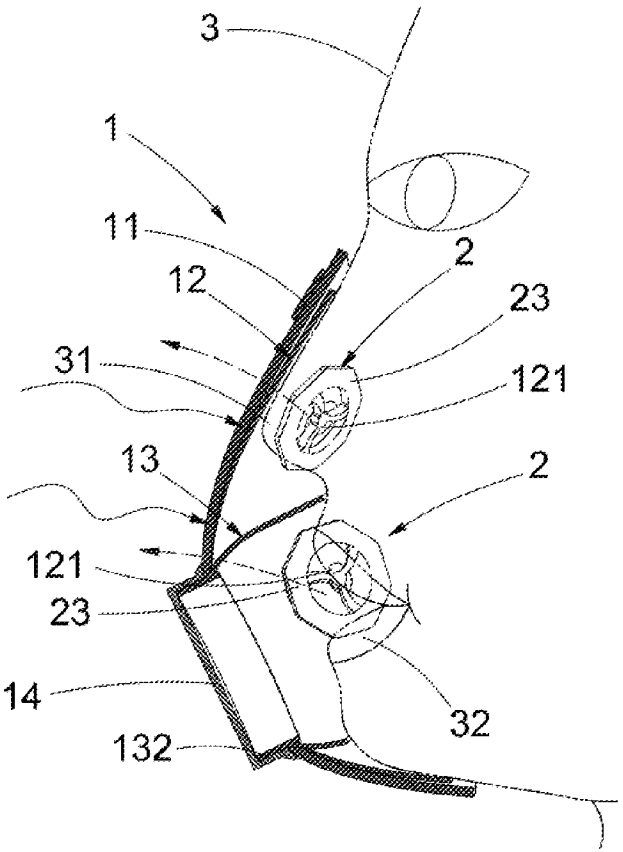
FIG. 4 is a schematic view showing the inner mask member being provided with a cover member and being worn on the human face and served to separate the air inhaled from the nose from the air exhaled from the mouth and the nose according to one preferred embodiment of the present invention.
Figure 5:
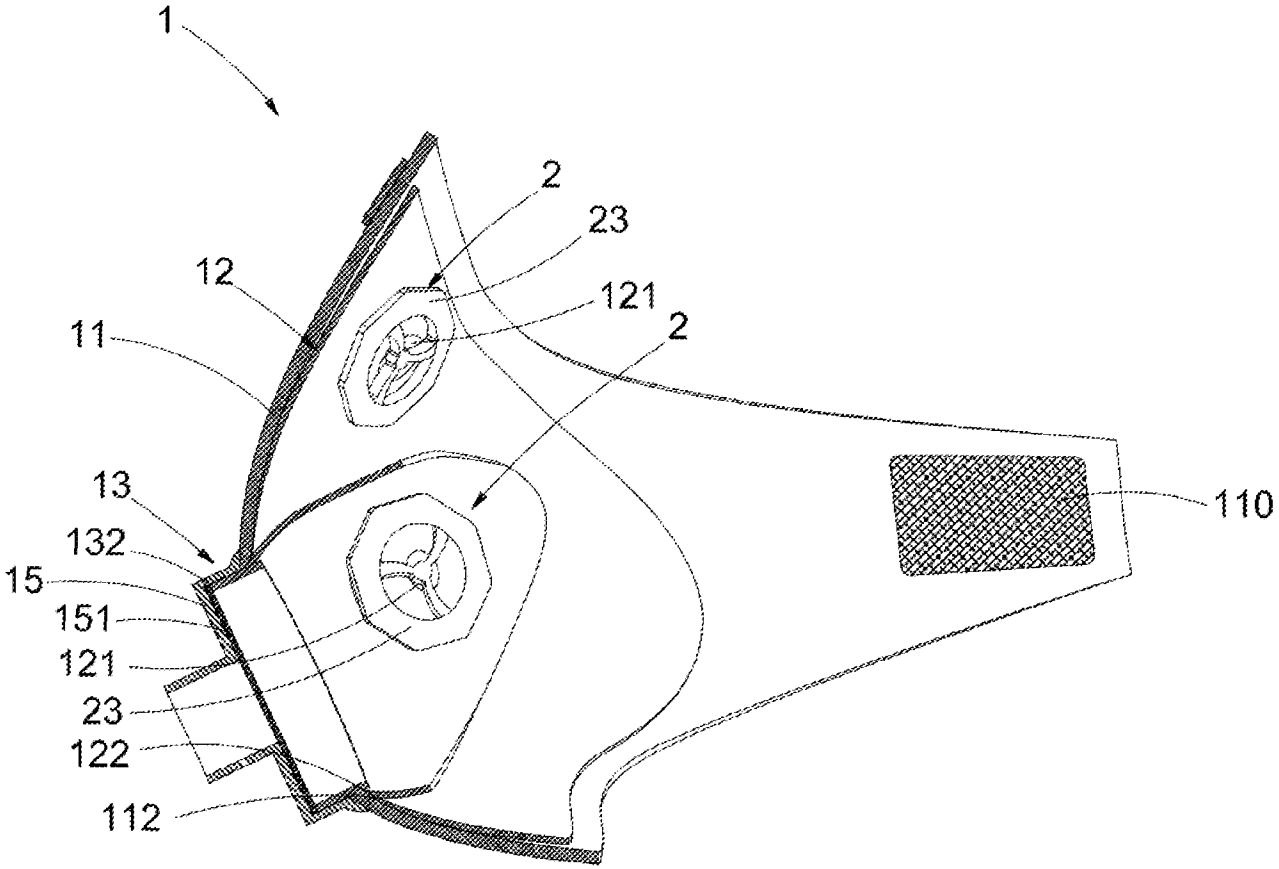
FIG. 5 is a schematic view showing the connection part being disposed with a connection head connected to an external equipment according to one preferred embodiment of the present invention.
Figure 6:
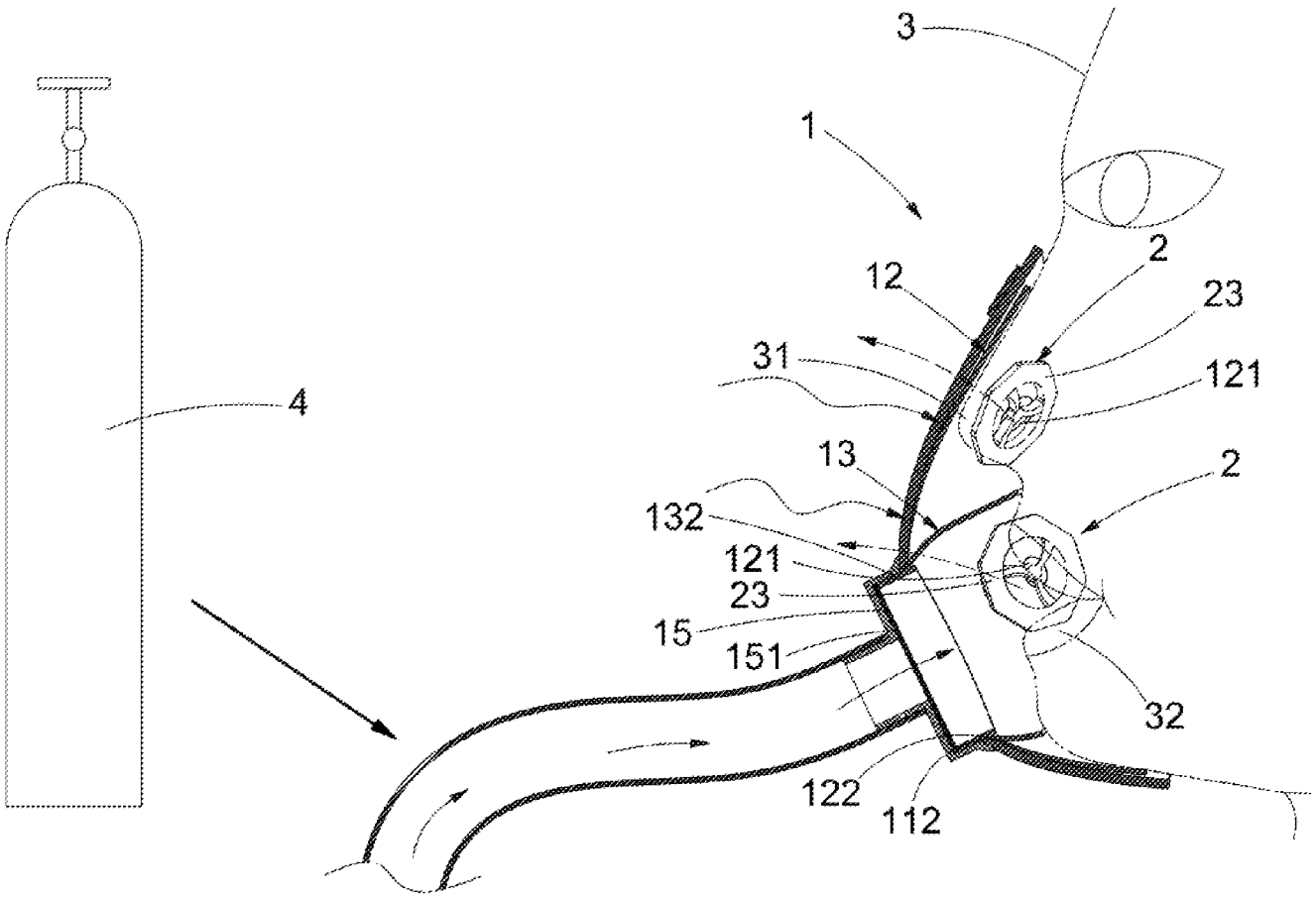
FIG. 6 is a schematic view showing the assembly of FIG. 5 being worn on the human face and served to separate the air inhaled from the nose and the air supplied by the external equipment from the air exhaled from the mouth and the nose according to one preferred embodiment of the present invention.

Please refer from FIG. 1 to FIG. 6, wherein FIG. 1 is a perspective exploded view according to the present invention; FIG. 2 is a perspective view showing the assembly according to the present invention; FIG. 3 is a cross sectional view showing the assembly according to the present invention; FIG. 4 is a schematic view showing the inner mask member being provided with a cover member and being worn on the human face and served to separate the air inhaled from the nose from the air exhaled from the mouth and the nose according to one preferred embodiment of the present invention; FIG. 5 is a schematic view showing the connection part being disposed with a connection head connected to an external equipment according to one preferred embodiment of the present invention; and FIG. 6 is a schematic view showing the assembly of FIG. 5 being worn on the human face and served to separate the air inhaled from the nose and the air supplied by the external equipment from the air exhaled from the mouth and the nose according to one preferred embodiment of the present invention. An improved gauze mask structure capable of separating inhalation and exhalation is provided according to one preferred embodiment of the present invention, which can be used for covering a human face 3, the nose 31 and the mouth 32. The gauze mask 1 includes an outer layer member 11, an inner layer member 12, an inner mask member 13 and at least two air valves 2.

The outer layer member 11 is provided for covering the human face 3, the nose 31 and the mouth 32, a top portion and a bottom portion of the outer layer member 11 are respectively formed with at least one first through hole 111, a center defined at the bottom portion of the outer layer member 11 is formed with a first front hole 112 arranged adjacent to the first through hole 111 at the bottom portion of the outer layer member 11; according to this embodiment, the material of which the outer layer member 11 is made can be a fabric or a plastic material, what shall be addressed is that the scope of the present invention is not limited to the above-mentioned materials, two sides of the outer layer member 11 are disposed with at least one fastening unit 110 for being fastened on a rear head portion of the human face 3; according to this embodiment, the fastening unit 110 is disposed at the two sides, formed in an elongated status, of the outer layer member 11, what shall be addressed is that the scope of the present invention is not limited to the above-mentioned arrangement; according to this embodiment, the fastening unit 110 disposed at the two sides, formed in the elongated status, of the outer layer member 11 is a Velcro fastening unit, so that the Velcro fastening unit adopted as the fastening unit 11 can be used for being adhered on the rear head portion so as to be fastened.

The inner layer member 12 is combined at an inner side of the outer layer member 11, a top portion and a bottom portion of the inner layer member 12 are respectively formed with at least one second through hole 121, a center defined at the bottom portion of the inner layer member 12 is formed with a second front hole 122 arranged adjacent to the second through hole 121 at the bottom portion of the inner layer member 12, the second through hole 121 and the second front hole 122 at the top portion and the bottom portion of the inner layer member 12 are respectively corresponding to the first through hole 111 at the top portion and the bottom portion of the outer layer member 11 and the first front hole 112 at the center defined at the bottom portion, the material of which the inner layer member 12 is made can be a cotton or a non-woven fabric material, what shall be addressed is that the scope of the present invention is not limited to the above-mentioned materials.

The inner mask member 13 is disposed at an inner side of the inner layer member 12, the inner mask member 13 is provided for covering the mouth 32 of the human face 3, the inner mask member 13 is formed with at least one third through hole 131 and disposed with a connection part 132 in a protruding status, the third through hole 131 is corresponding to the first through hole 111 at the bottom portion of the outer layer member 11 and the second through hole 121 at the bottom portion of the inner layer member 12, the connection part 132 is respectively corresponding to the first front hole 112 of the outer layer member 11 and the second front hole 122 of the inner layer member 12 and protruded out from the outer layer member 11.

The at least two air valves 2 are disposed corresponding to the first through hole 111 at the top portion of the outer layer member 11 and the second through hole 121 at the top portion of the inner layer member 12, and disposed corresponding to the first through hole 111 at the bottom portion of the outer layer member 11, the second through hole 121 at the bottom portion of the inner layer member 12 and the third through hole 131 of the inner mask member 13; each of the air valves 2 includes a top cover 21 and a bottom base 23 capable of being mutually engaged, and a valve piece 22 is disposed between the top cover 21 and the bottom base 23; according to this embodiment, the air valve is a unidirectional air valve 2, but what shall be addressed is that the scope of the present invention is not limited to the above-mentioned unidirectional air valve 2.

As shown from FIG. 1 to FIG. 4, when the gauze mask 1 of the present invention is desired to be used, the fastening unit 110, which is the above-mentioned Velcro fastening unit and formed in an elongated tail status, of the outer layer member 11 is adhered for being fastened at the rear head portion of the human face 3, so that the mouth 32 of the human face 3 can be covered by the inner mask member 13, and the air valves 2 are disposed in the outer layer member 11, the inner layer member 12 and the inner mask member 13, when the nose 31 of the human face 3 inhales air via the outer layer member 11 and the inner layer member 12, if the air is exhaled from the nose 31 of the human face 3, the air can be rapidly discharged from the air valve 2 disposed in the first through hole 111 at the top portion of the outer layer member 11 and the second through hole 121 at the top portion of the inner layer member 12, when the air is exhaled from the mouth 32 of the human face 3, because the mouth 32 of the human face 3 is covered by the inner mask member 13, and the connection part 132 is provided with a cover member 14, the exhaled air can be discharged from the air valve 2 via the first through hole 111 at the bottom portion of the outer layer member 11, the second through hole 121 at the bottom portion of the inner layer member 12 and the third through hole 131 of the inner mask member 13, so that residual exhaled air from the mouth 32 of the human face 3 is prevented from being remained inside the gauze mask 1, thus the air exhaled from the mouth 32 of the human face 3 and the air inhaled from the nose 31 of the human face 3 can be completely separated, thereby preventing the air containing a great amount of carbon dioxide and exhaled from the mouth 32 of the human face 3 from being inhaled by the nose 31 (as shown in FIG. 4).

As shown in FIG. 5 and FIG. 6, the connection part 132, disposed in the inner mask member 13 and protruded out from the outer layer member 11, is provided with a connection head 15, the connection head 15 is served to be connected to an external equipment 4 enabling the mouth 32 of the human face 3 to inhale air; according to this embodiment, the external equipment 4 is an oxygen container which is used in an environment in which the supply of oxygen is not enough, but what shall be addressed is that the scope of the present invention is not limited to the above-mentioned oxygen container; as shown in FIG. 5, when the present invention is desired to be used, the nose 31 of the human face 3 cannot only inhale air via the outer layer member 11 and the inner layer member 12, the air exhaled from the nose 31 of the human face 3 and the air exhaled from the mouth 32 of the human face 3 can be respectively discharged via the air valve 2 disposed in the first through hole 111 at the top portion of the outer layer member 11 and the second through hole 121 at the top portion of the inner layer member 12 and the air valve 2 correspondingly disposed in the first through hole 111 at the bottom portion of the outer layer member 11, the second through hole 121 at the bottom portion of the inner layer member 12 and the third through hole 131 of the inner mask member 13 (as show in FIG. 6), for enabling the connection head 15 connected to the external equipment 4 containing air to filter the air contained in the external equipment 4, the connection head 15 is provided with at least one filter layer 151 for filtering moisture and impurities, the filter layer 151 can be a made of a basic filtering material, for example active carbon or filtering net, but what shall be addressed is that the scope of the present invention is not limited to the above-mentioned arrangement.

Based on what has been disclosed above, advantages achieved by the present invention are as follows: with the air valve 2 disposed at the top portions of the outer layer member 11 and the inner layer member 12 and the inner mask member 13 and the air valve 2 disposed at the bottom portions thereof or the cover member 14 or the connection head 15 disposed in the connection portion 132 of the inner mask member 13, the air inhaled from the nose 31 via the outer layer member 11 and the inner layer member 12 covering the nose 31 and the mouth 32 of the human face 3 can be separated from the air exhaled from the mouth 32 via the inner mask member 13 and the air exhaled from the nose 31 and the mouth 32 of the human face 3 and discharged via the air valve 2, or the air inhaled from the mouth 32 of the human face 3 via the connection part 132 connected to the external equipment 4 and discharged from the nose 31 and the mouth 32 of the human face 3 via the air valve 2, so that the oxygen contained in the air can be effectively increased, the fresh air mixed with the exhaled air containing carbon dioxide can be prevented from being inhaled; accordingly, the present invention can be applied in various fields, and is novel and more practical in use comparing to the prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gauze mask comprising:

an outer layer member, configured to cover a nose and the a mouth of a human face, the outer layer member comprising:

a top portion and a bottom portion each formed with at least one first through hole;

a first front hole arranged in a center of the outer layer member adjacent to the at least one first through hole at the bottom portion of the outer layer member; and two sides, each of the two sides disposed with at least one fastening unit for being fastened on a rear head portion;

an inner layer member, configured to cover the nose and the mouth of the human face and secured to an inner side of the outer layer member, the inner layer member comprising:

a top portion and a bottom portion each formed with at least one second through hole aligned with the at least one first through hole in the top and bottom portions of the outer layer member, respective; and a second front hole arranged in a center of the inner layer member adjacent to the at least one second through hole at the bottom portion of the inner layer member and aligned with the front hole;

an inner mask member disposed at an inner side of the inner layer member and configured to cover the mouth of the human face while leaving the nose uncovered comprising:

at least one third through hole aligned with the at least one first through hole at the bottom portion of the outer layer member and the at least one second through hole at the bottom portion of the inner layer member; and a third front hole disposed with a connection part, the third front hole and connection part aligned with the first front hole of the outer layer member and the second front bole of the inner layer member, the connection part being arranged such that it protrudes outward from the outer layer member;

an air valve disposed in each through hole at the top portions of the inner and outer layer members; and an air valve disposed in each through hole at the bottom portions of the inner and outer layer members and the inner mask member;

wherein the values of the gauze mask allow separation of air inhaled from the nose and air exhaled from the nose and the mouth.

2. The gauze mask of claim 1, wherein the at least one fastening unit is defined by elongated, cooperating hook and loop fasteners.

3. The gauze mask of claim 1, wherein each of the air valves includes a top cover and a bottom base capable of being mutually engaged, and a valve piece is disposed between the top cover and the bottom base.

4. The gauze mask of claim 1, wherein the connection part is provided with a cover member.

5. The gauze mask of claim 1, wherein the connection part is provided with a connection head for connecting to an external equipment enabling the mouth to inhale air from the external equipment.

6. The gauze mask of claim 5, wherein the connection head is provided with at least one filter layer.

* * * * *